US011805850B1

(12) United States Patent
Dananberg et al.

(10) Patent No.: US 11,805,850 B1
(45) Date of Patent: Nov. 7, 2023

(54) CUBOID PAD

(71) Applicant: HBN SHOE, LLC, Salem, NH (US)

(72) Inventors: Howard Dananberg, Stowe, VT (US); Brian G. R. Hughes, San Antonio, TX (US)

(73) Assignee: HBN SHOE, LLC, Salem, NH (US)

( * ) Notice: Subject to any disclaimer, the term of this patent is extended or adjusted under 35 U.S.C. 154(b) by 0 days.

(21) Appl. No.: 18/223,946

(22) Filed: Jul. 19, 2023

(51) Int. Cl.

| | |
|---|---|
| ***A43B 7/14*** | (2022.01) |
| ***A43B 7/143*** | (2022.01) |
| ***A43B 23/07*** | (2006.01) |
| ***A43B 3/10*** | (2006.01) |
| ***A43B 13/38*** | (2006.01) |
| ***A43B 7/1405*** | (2022.01) |
| ***A43B 7/24*** | (2006.01) |
| ***A43B 7/1475*** | (2022.01) |
| ***A43B 7/22*** | (2006.01) |
| ***A43B 7/1435*** | (2022.01) |

(52) U.S. Cl.
CPC ..... *A43B 7/143* (2013.01); *A43B 3/101* (2013.01); *A43B 7/141* (2013.01); *A43B 7/1435* (2013.01); *A43B 7/1475* (2013.01); *A43B 7/223* (2013.01); *A43B 7/24* (2013.01); *A43B 13/386* (2013.01); *A43B 23/07* (2013.01)

(58) Field of Classification Search
CPC ..... A43B 7/14; A43B 7/1405; A43B 7/141; A43B 7/1415; A43B 7/149; A43B 7/143; A43B 7/1435
USPC ..... 36/43, 44
See application file for complete search history.

(56) References Cited

U.S. PATENT DOCUMENTS

| | | | |
|---|---|---|---|
| 73,924 | A | 1/1868 | Pickett |
| 975,576 | A | 11/1910 | Sexton |
| 1,055,768 | A | 3/1913 | Levee et al. |
| 1,137,092 | A | 4/1915 | Sharp |
| 1,210,066 | A | 12/1916 | Hara |
| 1,287,810 | A | 12/1918 | Wojteck |
| 1,387,952 | A | 8/1921 | Steinbrecher |

(Continued)

FOREIGN PATENT DOCUMENTS

| | | | |
|---|---|---|---|
| CL | 199601035 | 2/1997 | ..... A43B 17/00 |
| CN | 1233943 | 11/1999 | ..... A43B 13/40 |

(Continued)

OTHER PUBLICATIONS

"A Manual of Lower Extremities Orthotics", ed. Miles H. Anderson, pp, 109-11, 1972.

(Continued)

*Primary Examiner* — Marie D Bays
(74) *Attorney, Agent, or Firm* — HAYES SOLOWAY P.C.

(57) ABSTRACT

A human shoe sole has foot supporting upper surface including a first region for supporting the first, second, third, fourth and optionally fifth metatarsal heads of the foot of the wearer when the human shoe sole is worn; a second region for supporting the wearer's heel when the shoe sole is worn; and a section bridging the first section and the second section. The shoe sole includes a cuboid pad immediately forward the second section configured to underlie essentially the central interior region of the cuboid bone of the wearer, The cuboid pad includes an obliquely running groove or notch on a superior surface of the cuboid pad arranged to align with the location of the peroneus longus tendon of the wearer.

13 Claims, 3 Drawing Sheets

(56) References Cited

U.S. PATENT DOCUMENTS 1,550,715 A 6/1923 Stout
1,480,234 A 1/1924 Wedd
1,503,764 A 8/1924 Nickerson
1,544,625 A 7/1925 Austin
1,557,312 A 10/1925 Lelyveld
1,728,243 A 9/1929 Marshalek
1,760,300 A 5/1930 Donovan ..... 36/43
1,777,855 A 10/1930 Oblak ..... 36/43
1,819,539 A 8/1931 Bringardner
RE18,237 E 10/1931 Messler
1,827,044 A 10/1931 Simon
1,828,086 A 10/1931 Tweedie
1,847,287 A 3/1932 White
1,847,973 A 3/1932 Morton
1,864,999 A 6/1932 Gluckman
1,907,997 A 5/1933 Nickerson
1,957,695 A 5/1934 Chiapetta ..... 36/71
1,960,418 A 5/1934 Schaller ..... 36/71
1,992,081 A 2/1935 Madinger ..... 36/71
2,008,207 A 7/1935 Greenberg ..... 36/71
2,029,409 A 2/1936 Brand ..... 36/71
2,034,463 A 3/1936 Dvlinsky ..... 36/71
2,046,732 A 7/1936 Fein ..... 36/43
2,055,072 A 9/1936 Everston ..... 36/28
2,081,474 A * 5/1937 Burns ..... A43B 7/24
36/174
2,082,891 A 6/1937 Hubbard ..... A46B 7/1415
2,088,263 A 7/1937 Grouven ..... 36/8.5
2,092,910 A 9/1937 Daniels ..... 36/71
2,097,759 A 11/1937 Ehrlich ..... 36/71
2,106,508 A * 1/1938 Shaw ..... A43B 7/14
36/43
2,119,807 A 6/1938 Farley ..... 36/71
2,246,944 A 1/1939 Larkin ..... 36/71
2,154,997 A * 4/1939 Schipper ..... A43B 7/1415
36/166
2,156,532 A 5/1939 Greider ..... 36/2.5
2,161,565 A 6/1939 Freda ..... 36/71
2,221,202 A 11/1940 Ratcliff ..... 36/71
2,252,936 A 8/1941 Leydecker ..... 12/142
2,255,100 A 9/1941 Brady ..... 36/71
2,304,384 A 12/1942 Stemmons ..... 36/71
2,346,279 A 4/1944 Stritter ..... 36/44
2,379,000 A 6/1945 Gould ..... 36/8.5
D143,642 S 1/1946 Bouthillette ..... D7/5
2,411,901 A 12/1946 Silver ..... A43B 7/1415
2,413,534 A 12/1946 Watson ..... 36/71
2,423,622 A * 7/1947 Samblanet ..... A43B 7/143
36/43
2,424,107 A 7/1947 McCahan ..... 36/71
2,460,493 A 2/1949 Diamant ..... 36/8.5
2,468,887 A 5/1949 Malouf ..... A43B 7/143
2,475,417 A 7/1949 Wysowski ..... A43B 7/1445
2,486,653 A 11/1949 Hukill ..... A43B 7/1445
2,505,032 A 4/1950 De Voos ..... 36/11.5
2,588,317 A 6/1951 Schwartz ..... 36/76
2,567,028 A 9/1951 Rapisarda ..... A43B 7/1445
2,589,163 A 3/1952 Tieman ..... A43B 7/1445
2,628,440 A 2/1953 Leydecker ..... 36/71
2,658,288 A 11/1953 Scholl ..... 36/44
2,681,515 A * 6/1954 Frese, Jr. ..... A43B 7/22
36/178
2,710,462 A 6/1955 Swadburgh ..... A43B 7/145
2,760,281 A 8/1956 Cosin ..... A43B 7/14
2,814,133 A 11/1957 Herbst ..... 36/71
2,821,032 A 1/1958 Helfet ..... 36/71
2,826,834 A 3/1958 Ratcliff ..... 36/71
2,828,555 A 4/1958 Ledos ..... 36/71
2,863,231 A 12/1958 Jones ..... 36/71
2,897,611 A 8/1959 Schaller ..... 36/30
2,909,854 A 10/1959 Edelstein ..... 36/8.5
2,917,849 A 12/1959 Scholl ..... 36/71
2,928,193 A 3/1960 Kristan ..... 36/71
2,961,780 A 11/1960 McManus ..... 36/71
3,058,240 A 10/1962 Osgood ..... 36/91
3,068,872 A 12/1962 Brody ..... 128/595
3,084,695 A 4/1963 O'Donnell ..... 128/615
3,099,267 A 7/1963 Cherniak ..... 128/615
3,165,841 A 1/1965 Rollman ..... 36/2.5
3,187,069 A 6/1965 Pincus et al. ..... 264/45
3,233,348 A 2/1966 Gilkerson ..... 36/44
3,309,797 A 3/1967 Poitras ..... 36/80
3,333,353 A 8/1967 Garcia ..... 36/68
3,416,245 A 12/1968 Ferreira ..... 36/44
3,421,518 A * 1/1969 Wikler ..... A43B 7/145
36/76 R
3,449,844 A 6/1969 Spence ..... 36/44
3,530,489 A 9/1970 Appleton ..... 36/44
3,591,882 A 7/1971 Pearsall ..... 12/146
3,638,336 A 2/1972 Silverman ..... 36/44
3,643,353 A 2/1972 Weight ..... 36/44
3,646,692 A 3/1972 Glogg ..... 36/2.5
3,680,162 A 8/1972 Glickman ..... 12/142
3,730,169 A 5/1973 Fiber ..... 128/2
3,781,231 A 12/1973 Janssen et al. ..... 260/2.5
3,832,793 A 9/1974 Siskin ..... 36/2.5
3,842,519 A 10/1974 Lapidus ..... 36/44
3,847,720 A 11/1974 Laberinti ..... 161/159
3,935,044 A 1/1976 Daly ..... 156/79
3,942,206 A 3/1976 Diamant ..... 12/142
4,003,146 A 1/1977 Meier et al. ..... 36/44
4,048,732 A 9/1977 Stix ..... 36/34
4,054,706 A 10/1977 Shapiro ..... 428/213
4,055,699 A 10/1977 Hsiung ..... 428/311
D246,551 S 12/1977 Hansjosten et al. ..... D2/320
4,073,024 A 2/1978 Stix ..... 12/142
4,084,333 A 4/1978 Del Vecchio ..... 36/43
4,101,704 A 7/1978 Hiles ..... 428/218
4,124,946 A 11/1978 Tomlin ..... 36/43
4,128,950 A 12/1978 Bowerman et al. ..... 36/30
4,137,654 A 2/1979 Hlavac ..... 36/119
4,168,585 A 9/1979 Gleichner ..... 36/95
4,187,621 A 2/1980 Cohen ..... 36/44
4,188,736 A 2/1980 Keller ..... 36/80
4,235,026 A 11/1980 Plagenhoff ..... 36/32
4,237,626 A 12/1980 Brown ..... 12/146 B
4,240,214 A 12/1980 Sigle et al. ..... 36/30
4,266,350 A 5/1981 Laux ..... 36/44
4,268,980 A 5/1981 Gudas ..... 36/43
4,272,899 A 6/1981 Brooks ..... 36/129
4,285,144 A 8/1981 Power ..... 36/44
4,291,428 A 9/1981 Anzani ..... 36/44
4,292,263 A 9/1981 Hanrahan et al. ..... 264/469.9
4,296,053 A 10/1981 Doerer et al. ..... 264/26
4,302,892 A 12/1981 Adamik ..... 36/31
4,307,521 A 12/1981 Inohara et al. ..... 36/31
4,316,335 A 2/1982 Giese et al. ..... 36/129
4,317,293 A 3/1982 Sigle et al. ..... 36/43
4,320,588 A 3/1982 Sottolana ..... 36/43
4,345,387 A 8/1982 Daswik ..... 36/43
4,346,205 A 8/1982 Hiles ..... 528/53
4,346,525 A 8/1982 Larsen et al. ..... 36/69
4,360,027 A 11/1982 Friedlander et al. ..... 128/581
4,364,189 A 12/1982 Bates ..... 36/31
4,367,599 A 1/1983 Diamant ..... 36/44
4,372,059 A 2/1983 Ambrose ..... 36/32
4,377,041 A 3/1983 Alchermes ..... 36/30
4,378,642 A 4/1983 Light et al. ..... 36/35
4,398,357 A 8/1983 Batra ..... 36/30
4,408,402 A 10/1983 Looney ..... 36/43
4,418,483 A 12/1983 Fujita et al. ..... 36/28
4,435,910 A 3/1984 Marc ..... 36/44
4,451,949 A 6/1984 Long ..... 12/146
4,455,340 A 6/1984 Okina ..... 428/215
4,472,890 A 9/1984 Gilbert ..... 36/28
4,490,928 A 1/1985 Kawashima ..... 36/69
4,494,321 A 1/1985 Lawlor ..... 36/28
4,506,462 A 3/1985 Cavanagh ..... 36/92
4,510,700 A 4/1985 Brown ..... 36/44
4,510,702 A 4/1985 Ehrlich, Jr. ..... 36/86
4,513,518 A 4/1985 Jalbert et al. ..... 36/44
4,515,851 A 5/1985 Johnson ..... 428/246
4,517,981 A 5/1985 Santopietro et al. ..... 128/581

(56) References Cited

U.S. PATENT DOCUMENTS

| | | | | |
|---|---|---|---|---|
| 4,527,345 | A | 7/1985 | Lopez Lopez | 36/127 |
| 4,541,184 | A | 9/1985 | Leighton | 36/44 |
| 4,541,186 | A | 9/1985 | Mulvihill | 36/114 |
| 4,557,060 | A | 12/1985 | Kawashima | 36/44 |
| 4,564,966 | A | 1/1986 | Chen | 12/146 |
| 4,581,187 | A | 4/1986 | Sullivan et al. | 264/46.4 |
| 4,586,273 | A | 5/1986 | Chapnik | 36/44 |
| 4,597,195 | A | 7/1986 | Dananberg | 36/28 |
| 4,608,988 | A | 9/1986 | Dananberg | 128/581 |
| 4,627,177 | A | 12/1986 | Meyers | 36/43 |
| 4,627,178 | A | 12/1986 | Sullivan et al. | 36/44 |
| 4,631,841 | A | 12/1986 | Hickey | 36/91 |
| D288,621 | S | 3/1987 | Surpuriya et al. | D2/961 |
| 4,670,996 | A | 6/1987 | Dill | 36/42 |
| 4,674,204 | A | 6/1987 | Sullivan et al. | 36/44 |
| 4,677,766 | A | 7/1987 | Gudas | 36/43 |
| 4,682,425 | A | 7/1987 | Simmons | 36/44 |
| 4,686,993 | A | 8/1987 | Grumbine | 128/581 |
| 4,689,898 | A | 9/1987 | Fahey | 36/43 |
| 4,769,926 | A | 9/1988 | Meyers | 36/43 |
| 4,777,739 | A | 10/1988 | Hiles | 36/43 |
| 4,782,605 | A | 11/1988 | Chapnick | 36/44 |
| 4,798,010 | A | 1/1989 | Sugiyama | 36/30 |
| 4,803,989 | A | 2/1989 | Collins | A43B 7/1445 |
| 4,813,157 | A | 3/1989 | Boisvert | A43B 7/142 |
| 4,835,884 | A | 6/1989 | Bianchini et al. | 36/24.5 |
| D302,764 | S | 8/1989 | Peoples et al. | D2/318 |
| 4,852,275 | A | 8/1989 | Bianchini et al. | 36/102 |
| 4,854,057 | A | 8/1989 | Misevich et al. | 36/114 |
| 4,866,860 | A | 9/1989 | Blissett et al. | 36/28 |
| 4,876,805 | A | 10/1989 | Peoples | 36/43 |
| 4,910,866 | A | 3/1990 | Sullivan et al. | 36/44 |
| 4,932,141 | A | 6/1990 | Hones | 36/43 |
| 4,936,030 | A | 6/1990 | Rennex | A43B 13/18 |
| 4,955,148 | A | 9/1990 | Padilla | 36/44 |
| 4,972,612 | A | 11/1990 | Prukop et al. | 36/145 |
| 5,014,706 | A | 5/1991 | Philipp | 128/581 |
| RE33,648 | E | 7/1991 | Brown | 36/44 |
| 5,063,692 | A | 11/1991 | Suginaka | 36/43 |
| 5,129,395 | A | 7/1992 | Hoffmann | A43B 7/142 |
| D329,129 | S | 9/1992 | Brown | D2/961 |
| 5,146,697 | A | 9/1992 | Weiss | 36/12 |
| 5,170,572 | A * | 12/1992 | Kantro | A43D 999/00 36/43 |
| 5,174,052 | A | 12/1992 | Schoenhaus et al. | 36/144 |
| 5,184,409 | A | 2/1993 | Brown | A43B 7/142 |
| 5,311,680 | A | 5/1994 | Comparetto | 36/154 |
| D353,710 | S | 12/1994 | Brazzell | D2/961 |
| 5,373,650 | A | 12/1994 | Dananberg et al. | 36/92 |
| D362,956 | S | 10/1995 | Martin et al. | D2/961 |
| 5,509,218 | A | 4/1996 | Arcan et al. | 36/43 |
| 5,551,173 | A | 9/1996 | Chambers | 36/141 |
| 5,584,130 | A | 12/1996 | Perron | 36/44 |
| 5,625,965 | A | 5/1997 | Blissett et al. | 36/43 |
| 5,632,104 | A | 5/1997 | Zohar | 36/88 |
| 5,685,094 | A | 11/1997 | Lin | 36/141 |
| 5,722,186 | A | 3/1998 | Brown | A43B 1/0054 |
| 5,782,015 | A | 7/1998 | Dananberg | 36/34 |
| 5,787,608 | A | 8/1998 | Greenawalt | 36/11.5 |
| 5,787,610 | A | 8/1998 | Brooks | 36/28 |
| 6,000,147 | A | 12/1999 | Kellerman | 36/160 |
| 6,041,524 | A | 3/2000 | Brooks | 36/93 |
| 6,131,311 | A | 10/2000 | Brown et al. | 36/43 |
| 6,253,469 | B1 | 7/2001 | Atlani et al. | 36/174 |
| 6,282,816 | B1 | 9/2001 | Rosendahl | 36/44 |
| 6,412,198 | B1 | 7/2002 | Rothbart | 36/144 |
| 6,481,120 | B1 | 11/2002 | Xia et al. | |
| 6,510,626 | B1 * | 1/2003 | Greenawalt | A43B 7/142 36/43 |
| 6,604,301 | B1 | 8/2003 | Manoli, II et al. | 36/43 |
| 6,889,452 | B2 | 5/2005 | Ailey et al. | 36/44 |
| D513,358 | S | 1/2006 | Amado et al. | D2/961 |
| 7,013,583 | B2 | 3/2006 | Greene et al. | 36/28 |
| 7,062,866 | B2 | 6/2006 | Bussier | A43B 7/142 |
| 7,124,520 | B2 | 10/2006 | Galbraith et al. | 36/43 |
| 7,143,530 | B2 | 12/2006 | Hudson et al. | 36/128 |
| 7,200,955 | B2 | 4/2007 | Foxen | 36/25 R |
| 7,264,604 | B1 | 9/2007 | Schuren et al. | 602/8 |
| 7,266,913 | B2 | 9/2007 | Axt et al. | 36/174 |
| 7,322,132 | B2 | 1/2008 | Dananberg | 36/174 |
| 7,380,352 | B2 | 6/2008 | Seiter | 36/44 |
| 7,484,319 | B2 | 2/2009 | Cheskin et al. | 36/44 |
| 7,526,882 | B2 | 5/2009 | Rhenter | 36/174 |
| 7,594,346 | B2 | 9/2009 | Dananberg | 36/174 |
| 7,814,688 | B2 | 10/2010 | Dananberg | 36/174 |
| 7,962,986 | B2 | 6/2011 | Dananberg | 12/142 N |
| 8,166,674 | B2 | 5/2012 | Dananberg | 36/43 |
| 9,055,781 | B2 | 6/2015 | Tzeng | |
| 9,345,287 | B2 | 5/2016 | Dananberg et al. | A43B 3/14 |
| 9,460,557 | B1 | 10/2016 | Tran et al. | |
| 10,702,008 | B2 | 7/2020 | Hughes et al. | A43B 7/141 |
| 2003/0024134 | A1 | 2/2003 | Howlett et al. | A43B 13/18 |
| 2004/0103558 | A1 | 6/2004 | Everz | A43B 17/00 |
| 2004/0118017 | A1 | 6/2004 | Dalton et al. | 36/44 |
| 2005/0060909 | A1 | 3/2005 | Kerns et al. | 36/28 |
| 2005/0166425 | A1 * | 8/2005 | Seiter | A43B 7/144 36/28 |
| 2006/0123663 | A1 | 6/2006 | Swensen | A43B 7/1464 |
| 2007/0033834 | A1 | 2/2007 | Cheskin | A43B 7/141 |
| 2008/0086909 | A1 | 4/2008 | Raspini | 36/44 |
| 2009/0049712 | A1 | 2/2009 | Steszyn et al. | 36/91 |
| 2009/0307925 | A1 | 12/2009 | Pfister | 36/28 |
| 2010/0146816 | A1 | 6/2010 | Cappaert | 36/91 |
| 2010/0287795 | A1 | 11/2010 | Van Niekerk | A43B 13/14 |
| 2011/0035960 | A1 | 2/2011 | Werremeyer | A43B 7/142 |
| 2011/0185590 | A1 | 8/2011 | Nishiwaki | A43B 5/06 |
| 2011/0232129 | A1 | 9/2011 | Roberts | A43B 7/1445 |
| 2012/0174436 | A1 | 7/2012 | Hanak | 36/43 |
| 2012/0255199 | A1 | 10/2012 | Tzeng | 36/43 |
| 2013/0104423 | A1 | 5/2013 | Hatfield | A43B 5/001 |
| 2013/0167403 | A1 * | 7/2013 | Kitagawa | A43B 7/143 36/43 |
| 2013/0205620 | A1 | 8/2013 | Hsu | A43B 7/14 |
| 2013/0232816 | A1 | 9/2013 | Eadie | A43B 7/149 |
| 2013/0247418 | A1 | 9/2013 | Nurse | A43B 3/0031 |
| 2013/0283646 | A1 | 10/2013 | Selner | A43B 7/00 |
| 2015/0000158 | A1 * | 1/2015 | Wang | A43B 17/02 36/43 |
| 2016/0015120 | A1 | 1/2016 | Denison | A43B 3/0094 |
| 2017/0007160 | A1 | 1/2017 | Latterman | A61N 5/107 |
| 2017/0027277 | A1 | 2/2017 | Anthony et al. | A43B 7/14 |
| 2017/0055640 | A1 | 3/2017 | Shrum et al. | A43B 17/00 |
| 2017/0251749 | A1 | 9/2017 | Hughes et al. | A43B 7/141 |
| 2017/0295883 | A1 | 10/2017 | Frey | |
| 2018/0092429 | A1 | 4/2018 | Hughes et al. | A43B 7/141 |
| 2018/0200099 | A1 | 7/2018 | Hanft | A43B 7/144 |
| 2019/0261732 | A1 | 8/2019 | Hughes et al. | A43B 7/14 |
| 2021/0298412 | A1 | 9/2021 | Takahashi | A43B 17/02 |

FOREIGN PATENT DOCUMENTS

| | | | |
|---|---|---|---|
| CN | 2688103 | 3/2005 | A43B 17/08 |
| CN | 2770419 | 4/2006 | A43B 13/14 |
| CO | 6930029 | 4/2014 | A43B 3/24 |
| DE | 660551 | 3/1938 | A43B 13/00 |
| DE | 875466 | 7/1949 | A43B 7/22 |
| EP | 427556 | 5/1991 | A43B 7/08 |
| EP | 591909 | 10/1993 | A43B 7/00 |
| FR | 1163646 | 9/1958 | A43B 13/14 |
| FR | 1207258 | 2/1960 | A43B 13/38 |
| FR | 1413280 | 10/1965 | A43B 13/41 |
| FR | 2015914 | 4/1970 | A43B 13/00 |
| FR | 2272618 | 3/1975 | A43B 7/00 |
| FR | 2309169 | 5/1975 | A43B 7/00 |
| FR | 2427801 | 6/1978 | A43B 21/32 |
| FR | 2506132 | 5/1981 | A41D 27/12 |
| FR | 2522482 | 1/1982 | A43B 17/14 |
| GB | 217833 | 6/1924 | A43B 17/00 |
| GB | 452492 | 11/1934 | A43B 13/38 |
| GB | 500422 | 2/1939 | |
| GB | 644712 | 10/1950 | |
| GB | 1243575 | 8/1971 | A43B 17/14 |
| GB | 1564195 | 4/1980 | C08G 18/06 |
| GB | 2057964 | 4/1981 | B29D 9/06 |

(56) References Cited

FOREIGN PATENT DOCUMENTS

| | | | |
|---|---|---|---|
| GB | 2088776 | 6/1982 | ..... B32B 5/18 |
| GB | 2501893 | 11/2013 | ..... A43B 13/38 |
| HU | 209953 | 2/1995 | ..... A43B 13/40 |
| JP | 10-234417 | 8/1998 | ..... A43B 17/00 |
| JP | 2001-523981 | 11/2001 | ..... A43B 13/12 |
| WO | WO91071 | 5/1991 | ..... A61F 5/14 |
| WO | WO9200714 | 1/1992 | ..... A61H 7/00 |
| WO | WO9814083 | 4/1998 | ..... A43B 7/16 |
| WO | WO9818358 | 5/1998 | ..... A43B 7/22 |
| WO | WO2004012548 | 2/2004 | ..... A43B 7/22 |
| WO | WO2004093584 | 4/2004 | ..... A43B 7/38 |
| WO | WO2006043923 | 4/2006 | ..... A43B 19/00 |
| WO | WO2010085485 | 7/2010 | ..... A43B 13/14 |
| WO | WO2011017174 | 2/2011 | ..... A43B 13/38 |
| WO | WO2015112471 | 7/2015 | ..... A43B 13/40 |
| WO | WO2016178638 | 11/2015 | ..... A43B 13/18 |
| WO | WO2016185400 | 11/2016 | ..... G06Q 30/02 |

OTHER PUBLICATIONS

"Anthropometry of the Foot and lower Leg of U.S. Army Soldiers: Fort Jackson, SC—1985" Natick/TR-92/028, Natick, Ma: U.S. Army Natick Research, Development, and Engineering Center (ADA261405), 1992 (360 pgs).

"Common Foot Disorders: Diagnosis and Management", ed, Donald Neale, pp, 44-47, 5254, 65-66, 192-194, 1981.

"Lower Limb Orthotics: 1981 Revision", Prosthetics and Orthotics Department, New York University, Post- Graduate Medical School, pp. 172-179, copyright 1981.

"Mechanical Foot Therapy", Philip R. Brachman (The Leicht Press) pp. 292-295, 1946.

"New Styling for High-Heeled Comfort: The Classic Pump Redefined for Fashion Wear" Dananberg, Current Podiatric Medicine, 1990, pp. 39-32.

"Podopediatrics—The Care of Childrens Feet" by Herman R. Tax, B.S., Pod.D., Copyright 1947 ("Manual"), pp. Forward and 101-105 and 108-110.

"Shear Madness" Footwear News, vol. 53, No. 15 (2 pgs).

Herman R. Tax, D.P.M,, "Podopediatrics", 1980, pp. 189, 221-242.

Merton L. Root, D.P.M.; William P. Orien, D.P.M.; and John H. Weed, D.P.M.; normal and abnormal Function of the Foot, 1977, Clinical Biomechanics, vol. 11, 4 pgs.

Plastic insole from Standing Ovation™ Shoes by HBN Shoe, LLC,1997; U.S. Appl. No. 29/196,783 (copy of the "Artifact Sheet indicating an item has been filed which cannot be scanned" (dated Mar. 8, 2004) is provided in lieu of the original Plastic Insole) (1 pg).

* cited by examiner

FIG. 1 - Prior Art
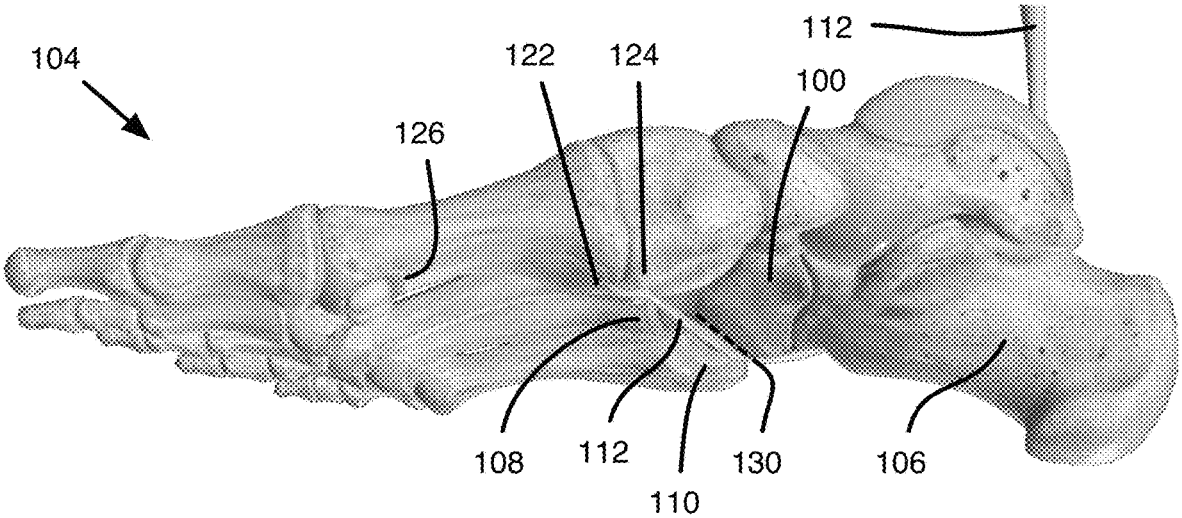
FIG. 2 - Prior Art
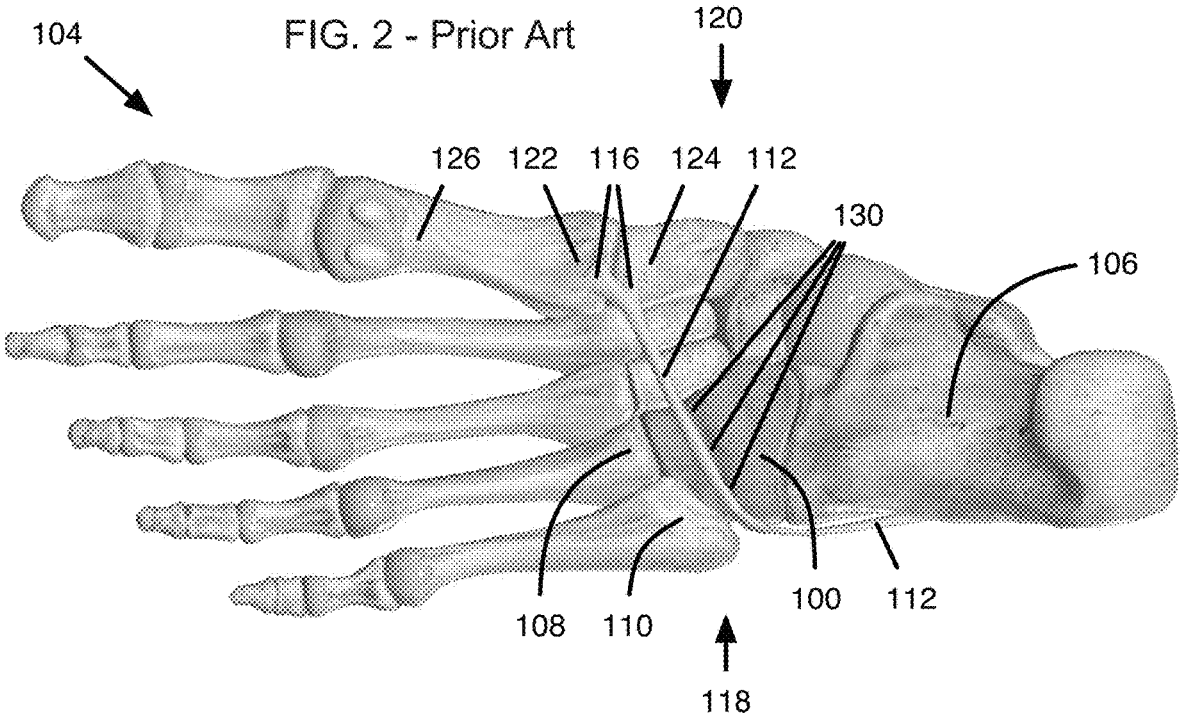

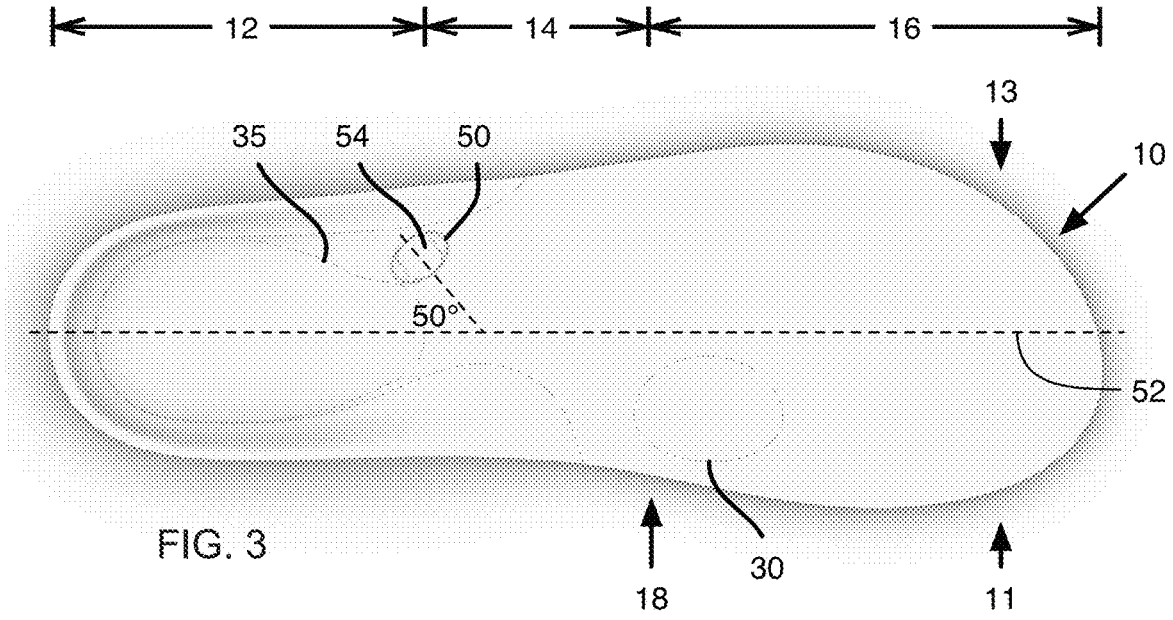
FIG. 3
FIG. 4
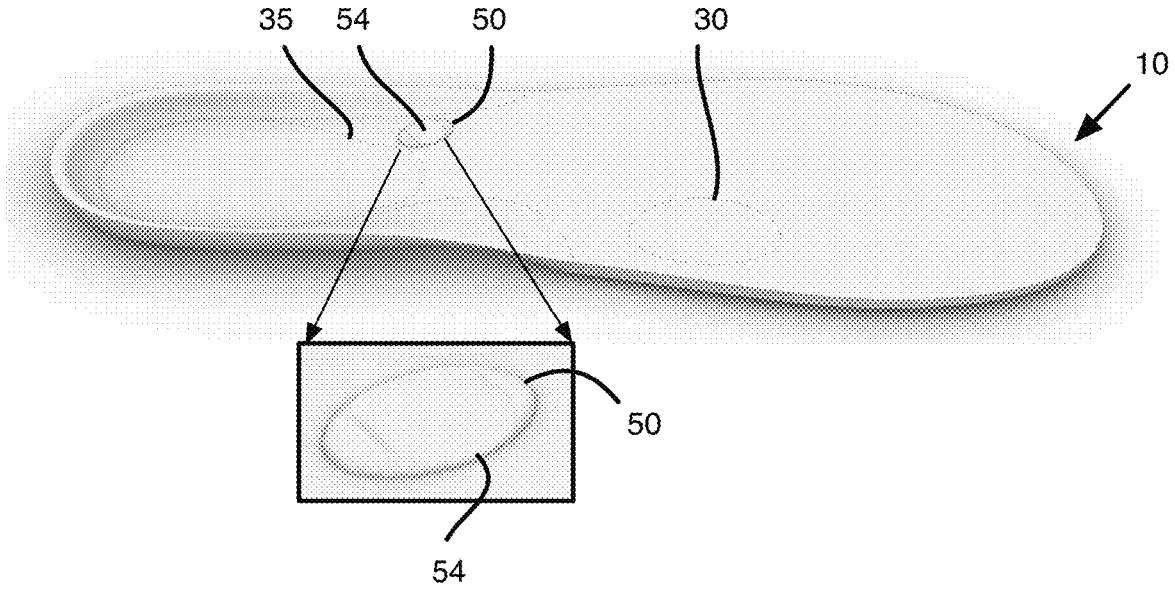

CUBOID PAD

FIELD OF THE DISCLOSURE

This disclosure relates to footwear, and more specifically to foot supporting structures for footwear having features that improve the comfort for the wearer during standing, walking and running. The disclosure has particular applicability for use in connection with reducing or eliminating pain from plantar fasciitis and will be described in connection with such utility. Although other utilities are contemplated.

BACKGROUND AND SUMMARY

Plantar fasciitis or plantar heel pain is a disorder of the plantar fascia, which is the connective tissue which supports the arch of the foot. It results in pain in the heel and bottom of the foot that is usually most severe with the first steps of the day or following a period of rest. Pain also is frequently brought on by bending the foot and toes up towards the shin. The pain typically comes on gradually, and it affects both feet in about one-third of cases.

The cause of plantar fasciitis is not entirely clear. Risk factors include overuse, such as from long periods of standing, an increase in exercise, and obesity. It is also associated with inward rolling of the foot, a tight Achilles tendon, and a sedentary lifestyle. It is unclear if heel spurs have a role in causing plantar fasciitis even though they are commonly present in people who have the condition. Plantar fasciitis is a disorder of the insertion site of the ligament on the bone characterized by micro tears, breakdown of collagen, and scarring.

Most cases of plantar fasciitis resolve with time and conservative methods of treatment. For the first few weeks, those affected are usually advised to rest, change their activities, take pain medications, and stretch. If this is not sufficient, physiotherapy, orthotics, splinting, or steroid injections may be options. If these measures are not effective, additional measures may include extracorporeal shockwave therapy or surgery.

Between 4% and 7% of the general population reportedly has heel pain at any given time: about 80% of these are due to plantar fasciitis. Approximately 10% of people reportedly have the disorder at some point during their life.

Cuboid pads have been used in podiatry and orthotic construction for many years. Cuboid pads are used to treat cuboid foot pain and prevent the cuboid bone from excessive plantar movement during walking. Referring to FIGS. 1 and 2, cuboid 100 is a bone on the lateral side of the foot 104 and is jointed at its heelward or posterior end to the calcaneus 106, and to the bases 108, 110 of the 4th and 5th metatarsals at its toeward end.

The peroneus longus tendon 112 is the connection of the peroneus longus muscle (on the lateral side of the lower leg) to the insertion points on the inferior surface 116 of the human foot. From the lateral side 118, the tendon 112 makes a turn medially directly under the cuboid 100. From the cuboid 100 to the medial side 120 of the foot 104, the tendon 112 connects to the base 122 of the 1$^{st}$ metatarsal and to the medial cuneiform bone 124. Its action is to stabilize the entire 1$^{st}$ ray 126 to the ground during the second half of single support phase. Tendon 112 uses the cuboid 100 as a fulcrum point to provide mechanical advantage for the 1$^{st}$ ray 126 support against ground reactive force. On the inferior surface of cuboid 100, there is a notch 130 known as the peroneal groove or notch, and this is where the tendon 112 changes direction from a vertical to horizontal direction.

In accordance with the present disclosure, we provide a foot supporting surface such as a footwear sole with a cuboid pad having a groove or notch on a superior surface of the pad and aligned with the axis of pull of the peroneus longus tendon. The notch or groove on the superior surface of the cuboid pad, which in a preferred embodiment is in the form of a flattened cylindrically shaped groove or notch, essentially the location mirrors the peroneal sulcus of the cuboid, thus accommodating the peroneal tendon, to permit its normal function during weightbearing activities. The orientation of the groove or notch in the cuboid pad is critical to its function. The axis of the groove or notch on the cuboid pad runs obliquely from the lateral to medial side of the foot and is arranged to align with the location of peroneus longus tendon so as to direct the angle of pull of the peroneus longus tendon to the base of the 1$^{st}$ metatarsal cuneiform. Even though the cuboid pad is oriented to run generally from heel to toe, the groove or notch on the superior surface of the cuboid pad is obliquely angled at about 50° to an imaginary line drawn from heel to toe and oriented laterally to medially.

The cuboid pad is placed on the superior or outer surface of the footwear sole in the midfoot area and is configured to lie essentially immediately below the central inferior cuboid bone. The cuboid pad ranges in thickness from about 0.5 to about 2 mm at its maximum height. Cuboid pads have been used in the past for addressing various foot pain symptoms. However, prior art cuboid pads were all shaped as a convex surface extending into the interior of the footwear.

By providing an obliquely running concave surface, or groove or notch on the superior surface of the cuboid pad, in accordance with the present disclosure, we provide a cuboid pad and its advantages without restricting the motion of the perineal tendon.

More particularly, in accordance with the present disclosure there is provided a human shoe sole having foot supporting upper surface including a first region for supporting the first, second, third, fourth and optionally fifth metatarsal heads of the foot of the wearer when the human shoe sole is worn; a second region for supporting the wearer's heel when the shoe sole is worn; and a section bridging the first section and the second section, wherein the shoe sole includes a cuboid pad immediately forward the second section configured to underlie essentially the central interior cuboid bone of the wearer, wherein the cuboid pad includes an obliquely running concave surface or groove or notch on a superior surface of the cuboid pad arranged to align with the peroneus longus tendon of the wearer.

In one aspect the groove or notch on the superior surface of the cuboid pad is in the form of a flattened cylindrically shaped groove or notch.

In another aspect the groove or notch on the superior surface of the cuboid pad runs at about 50° to an imaginary line bisecting the human shoe sole, and oriented laterally to medially of the shoe sole.

In yet another aspect, the human shoe sole is formed as an integral structural element of a shoe or boot.

In a further aspect the human shoe sole is formed as an insole of a shoe or boot.

In yet another aspect, the human shoe sole is formed as a separate removable element of a shoe or boot product.

In a further aspect the human shoe sole is formed as a sock liner or removable insole for a shoe or boot.

In another aspect the human shoe sole is formed as an aftermarket insole for a shoe or boot.

In a further aspect the human shoe sole is formed as a custom or prefabricated foot orthotic.

In yet another aspect the human shoe sole is formed directly into the foot supporting surface of a shoe or boot.

1 In a further aspect, the human shoe sole is part of a shoe which comprises a sandal, a flip-flop or a molded footwear product.

In yet another aspect, the cuboid pad is 1-2 mm at its highest point.

In a still further aspect, the cuboid pad groove or notch is about 1 mm deep measured from a high point on the cuboid pad.

BRIEF DESCRIPTION OF THE DRAWINGS

Further features and advantages of the present disclosure will be seen form the following detailed description, taken in conjunction with accompanying drawings, wherein:

FIG. 1 is a side view and FIG. 2 is a bottom view of the bones of a human foot; in which the cuboid bone is highlighted and the peroneus longus tendon is shown.

FIG. 3 is a top plan view of a footwear sole incorporating a notched cuboid pad in accordance with present disclosure;

FIG. 4 is a perspective view of the footwear pad of FIG. 3; and

DETAILED DESCRIPTION

Figure 5:
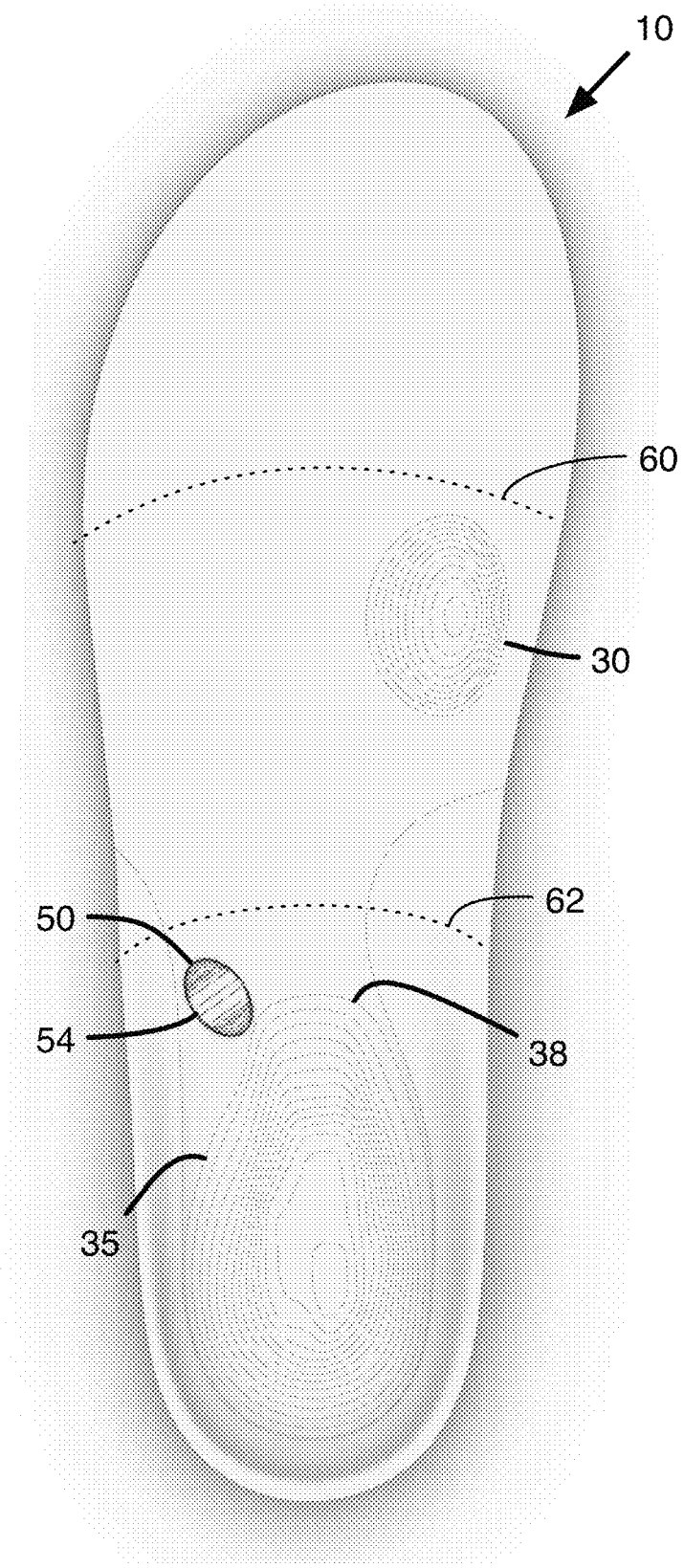
FIG. 5 is a top plan view showing details of a footwear sole of FIG. 3, with contour lines taken at 0.2 mm superimposed thereon.

As used herein the term "foot supporting surface" is used interchangeably with "sole" and "inner sole", and may include full, or three quarter soles, and half soles or heel pads and may be a structure built into or forming an integral element of a footwear product such as an insole board, or as a separate element, including, e.g. a sock liner or removable insole, an after-market insole device, or a custom or prefabricated foot orthotic, which may be inserted into a footwear product post-manufacture. The element also may be molded into or formed in the foot supporting surface of a shoe such as sandal or flip-flop or other form of molded footwear product.

Referring to FIGS. 3-5 of the drawings, there is disclosed a left foot footwear sole 10 having a cuboid pad in accordance with the present disclosure. It will be understood by one skilled in the art that the right footwear sole will be a mirror image of the illustrated left footwear sole.

The footwear sole has a heel section 12 which starts at the back of the sole 10 and runs forward towards the front of the sole and is configured to underly the heel of the wearer's foot and includes medial and lateral regions 11 and 13, respectively, corresponding to the inner and outer sides of the sole 10. The forefront section 16 essentially starts at point 18 where the head of the first metatarsal head of the wearer's foot overlies the sole 10. A midsection 14 bridges the heel section 12 and the forefoot section 16 and is configured to underly the arch of the wearer's foot. The forefoot section 16 includes a depression or area of reduced support 30 configured to underlie the first metatarsal head of the wearer, i.e., in accordance with the teachings of U.S. Pat. No. 8,166,674, issued May 1, 2012 to Howard J. Dananberg, one of the inventors hereof, the contents of which are incorporated herein by reference The region of depressed area 30 may be formed of a resiliently deformable material that offers less resistance to downward movement than the regions surrounding the depressed area 30, or may be formed as a depression or contour.

Insole 10 includes a heel cup 35 made in accordance with the teachings of our prior U.S. Pat. No. 10,702,008, issued Jul. 7, 2020, the contents of which are incorporated herein by reference. Heel cup 35 is in the form of an asymmetric generally round shaped depression and includes a forward depressed extension region 38 on its medial side, which serves to reduce pressure on the plantar facia of the wearer's foot as it travels from its attachment on the medial calcaneus to the proximal phalanges. Heel cup 35 typically is 1-4 mm deep at its lowest point, preferably 2-3.5 mm deep, more preferably 2.5-3 mm deep.

In accordance with the present disclosure, we provide a cuboid pad 50 immediately forward the heel cup 35 on the lateral side of the heel cup, i.e., on the lateral side in the midfoot region. Cuboid pad 50 is configured to fall essentially immediately below the central inferior region of the cuboid bone 100 (see FIGS. 1 and 2) of the wearer. Cuboid pad 50 typically is about 20 mm long, and 1-2 mm at its highest point, preferably 1-1.5 mm high, more preferably 1-1.25 mm high. Cuboid pad 50 includes a groove or notch 54 about 12.5 mm wide, and about 1 mm deep, running from the lateral to medial side of the foot at an oblique axis angle of 50° relative to an imaginary line 52 running from the center of the heel section 12 to the center of the forefoot section 16 of the footwear sole 10, and is arranged to align with the peroneus longus tendon of the foot of the wearer. While the cuboid pad 50 is oriented slightly oblique to imaginary line 52 from the center of heel section to the center of the toe section of footwear sole 10, groove or notch 54 on the superior surface of the cuboid pad 50 is oriented to run close to 90° perpendicular to the elongate orientation of the cuboid pad 50 and is oriented essentially to run in a direction of within about 50° to a lateral to medial orientation. As so formed, the peroneal tendon of a wearer is accommodated within the groove or notch 54 and is free to assume its normal function. Thus, we are able to correct for over supination, without causing or exacerbating plantar fasciitis.

Various changes may be made in the foregoing disclosure without departing from the spirit and scope thereof. For example, while the footwear sole has been described as comprising a full footwear sole, underlying the heel, arch and forefoot regions of the wearer's foot, the footwear sole could comprise a shortened sole such as a ¾ sole, i.e., essentially extending from the heel to line 60. Also, the foot supporting surface having a cuboid pad in accordance with the present disclosure may be formed in a heel piece only, i.e., essentially extending from the heel to line 62. The cuboid pad and heel depression also may be formed in a molded footbed such as for a flip-flop or sandal.

Various other changes may be made without departing from the spirit and scope of the present disclosure.

What is claimed:

1. A human shoe sole having foot supporting upper surface including a first region for supporting the first, second, third, fourth and optionally fifth metatarsal heads of a foot of a wearer when the human shoe sole is worn; a second region for supporting the wearer's heel when the shoe sole is worn; and a section bridging the first section and the second section, wherein the shoe sole includes a cuboid pad immediately forward the second section configured to underlie essentially the central interior region of the cuboid bone of the wearer, wherein the cuboid pad includes an obliquely running groove or notch on a superior surface of the cuboid pad arranged to align with the location of the peroneus longus tendon of the wearer.

2. The human shoe sole of claim 1, wherein the groove or notch on the superior surface of the cuboid pad is in the form of a flattened cylindrically shaped groove or notch.

3. The human shoe sole of claim 1, wherein the groove or notch on the superior surface of the cuboid pad runs at about 50° to an imaginary line bisecting the human shoe sole, and oriented laterally to medially of the shoe sole.

4. The human shoe sole of claim 1, formed as an integral structural element of a shoe or boot.

5. The human shoe sole of claim 1, formed as an insole of a shoe or boot.

6. The human shoe sole of claim 1, formed as a separate removable element of a shoe or boot product.

7. The human shoe sole of claim 1, formed as a sock liner or removable insole for a shoe or boot.

8. The human shoe sole of claim 1, formed as an after-market insole for a shoe or boot.

9. The human shoe sole of claim 1, formed as a custom or prefabricated foot orthotic.

10. The human shoe sole of claim 1, formed directly into the foot supporting surface of a shoe or boot.

11. The human shoe sole of claim 10, wherein the shoe comprises a sandal, a flip-flop or a molded footwear product.

12. The human shoe sole of claim 1, wherein the cuboid pad is 1-2 mm at its highest point.

13. The human shoe sole of claim 1, wherein the cuboid pad groove or notch is about 1 mm deep measured from a high point on the cuboid pad.

* * * * *